US009989207B2

(12) United States Patent
David

(10) Patent No.: US 9,989,207 B2
(45) Date of Patent: Jun. 5, 2018

(54) LIGHT DEVICE, ESPECIALLY A PROJECTOR SYSTEM OF A HEADLIGHT FOR MOTOR VEHICLES

(71) Applicant: Varroc Lighting Systems, s.r.o., Senov u Noveho Jicina (CZ)

(72) Inventor: Tomas David, Zasova (CZ)

(73) Assignee: Varroc Lighting Systems, s.r.o. (CZ)

( * ) Notice: Subject to any disclaimer, the term of this patent is extended or adjusted under 35 U.S.C. 154(b) by 0 days. days.

(21) Appl. No.: 15/352,434

(22) Filed: Nov. 15, 2016

(65) Prior Publication Data

US 2017/0146210 A1 May 25, 2017

(30) Foreign Application Priority Data

Nov. 20, 2015 (CZ) ..... 2015-823

(51) Int. Cl.
*F21V 7/00* (2006.01)
*F21S 8/10* (2006.01)
*F21Y 115/10* (2016.01)

(52) U.S. Cl.
CPC ..... *F21S 41/143* (2018.01); *F21S 41/141* (2018.01); *F21S 41/25* (2018.01); *F21S 41/28* (2018.01); *F21S 41/285* (2018.01); *F21S 41/321* (2018.01); *F21S 41/36* (2018.01); *F21S 41/39* (2018.01); *F21S 41/435* (2018.01); *F21S 41/47* (2018.01); *F21S 48/115* (2013.01); *F21S 48/1225* (2013.01); *F21S 48/1233* (2013.01); *F21S 48/1305* (2013.01); *F21S 41/365* (2018.01); *F21S 45/40* (2018.01); *F21S 45/47* (2018.01); *F21S 48/32* (2013.01); *F21Y 2115/10* (2016.08)

(58) Field of Classification Search
None
See application file for complete search history.

(56) References Cited

U.S. PATENT DOCUMENTS

2013/0308329 A1 11/2013 Danner et al.

FOREIGN PATENT DOCUMENTS

| | | |
|---|---|---|
| DE | 19860669 A1 | 7/2000 |
| DE | 10359185 A1 | 7/2005 |
| EP | 1033527 A2 | 3/2000 |

(Continued)

OTHER PUBLICATIONS

Search Report from Corresponding Czech Patent Application PV 2015-823 dated Apr. 18, 2016 (3 pages).

*Primary Examiner* — Vip Patel
(74) *Attorney, Agent, or Firm* — Hovey Williams LLP; Joan Herman

(57) ABSTRACT

A light device comprises at least one light source (10) to generate light rays (201, 202, 203), an output lens (5), and lateral walls (7, 8) delimiting a space (27) for passage of the light rays after the lens and exiting out of the light device through a transparent cover (9) covering the space at the front. Between the light source and the output lens, a reflective diaphragm (11) is arranged that comprises fixed reflective lateral walls (11*a*, 11*b*), for spatial delimitation of the light rays between the lateral walls before they enter the output lens. The output lens has, in the vertical direction at the side facing the diaphragm, a convex shape and the lateral walls include, at the side facing the output lens, free ends (14) that have a rounded concave shape in the vertical direction, which is substantially complementary to the output lens convex shape.

8 Claims, 7 Drawing Sheets

(56) References Cited

FOREIGN PATENT DOCUMENTS

Figure 1:
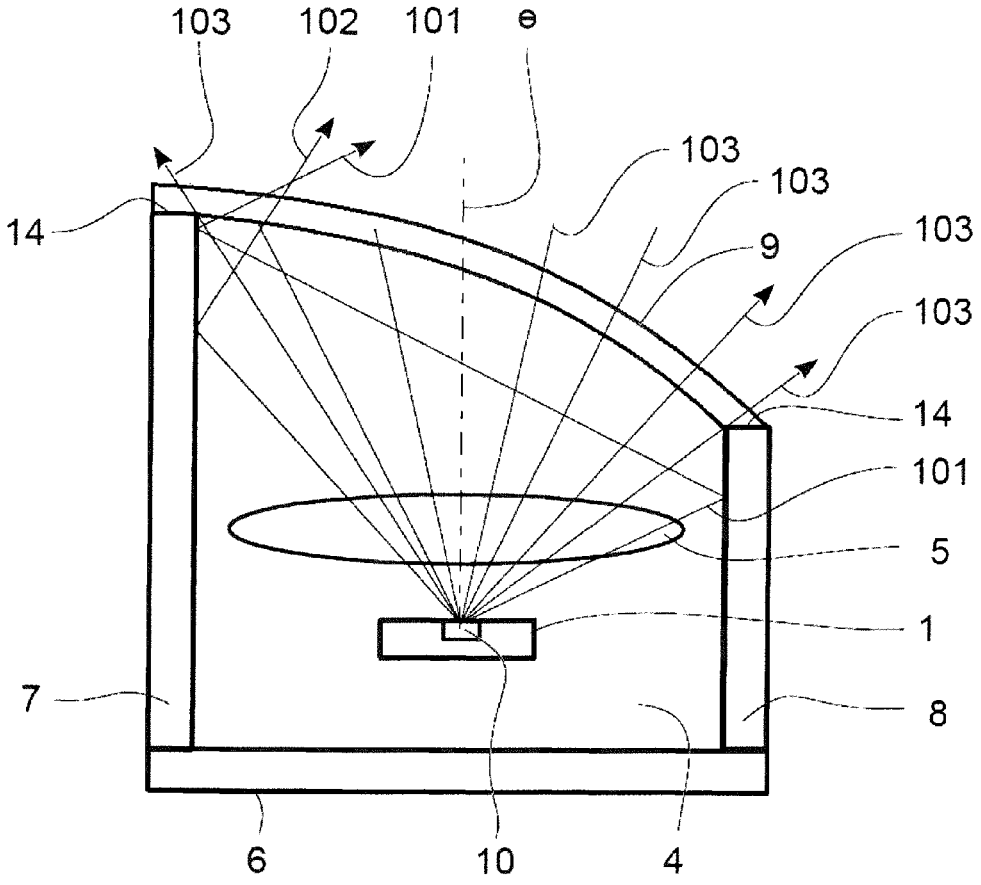
Fig.1 Prior Art

| | | | |
|---|---|---|---|
| EP | 1970619 | A1 | 9/2008 |
| EP | 2101107 | A2 | 9/2009 |
| JP | 2009199752 | A | 9/2009 |
| WO | 2012/109681 | A1 | 8/2012 |

LIGHT DEVICE, ESPECIALLY A PROJECTOR SYSTEM OF A HEADLIGHT FOR MOTOR VEHICLES

FIELD OF THE INVENTION

The invention falls within the field of non-portable lighting devices, adapted specially for motor vehicles, and it relates to a projector system for headlights of motor vehicles that is designed to finish the required output characteristic of the light trace through spatial distribution of light in specific zones in front of the driver on the carriageway.

BACKGROUND INFORMATION

A headlight, especially for motor vehicles, contains at least one optical system comprising a powerful light source and optical elements. The light source emits light rays and the optical elements represent a system of refractive and reflective surfaces, interfaces of optical environments and diaphragms that influence the direction of light rays within the creation of the output light trace.

In modern headlights of motor vehicles, multifunctional projector systems are commonly used, containing more mutually independent light units to create the low beam or high beam light trace. In the prior art, contributive light units are known that contribute to the creation of the output characteristic of the light trace by emitting light in specific zones in front of the driver on the carriageway. These contributive systems emit light together with the basic projection unit designed for the low beam or high beam light functions, increasing the intensity of light in front of the vehicle and at the same time ensuring a wide distribution of light in the space, achieving better lighting of the zones at the edges of the carriageway.

For design reasons, headlights of motor vehicles are often subject to the requirement that the light source and output lens be mounted deeper in the headlight bushing, which leads to the result that the distance between the output lens and the translucent cover of the headlight is large. If the light source and the output lens are recessed deep in the headlight bushing, the space between the output lens and the translucent cover of the headlight is restricted from the lateral sides by the lateral walls of the covering mask or bushing, which create a side trimming of the light beam with their bevelled edges, which is manifested on the carriageway surface as a visible boundary between the area that is intensively lit by direct light rays and the area where the headlight does not light due to the trimming of the light beam. A visible boundary of the area illuminated by direct light rays is a disturbing element for drivers.

The disadvantages of deep recessing of the light source and output lens in the headlight bushing are mainly manifested with additional contributive systems whose task is to provide supplementary light functions to increase the total light output of the headlight. The additional contributive systems are usually arranged in the headlight bushing in one unit together with the basic projection unit or separately. They generally use planar LED light sources whose light beam gets wider in the direction towards the output lens at the same rate in the vertical direction as in the horizontal direction and is therefore significantly trimmed by the lateral bevelled edges of the bushing or the covering mask at the lateral sides.

It is true that the light pattern can be adapted or shifted in the horizontal direction to avoid creation of a visible boundary between the intensively lit area and the unlit are, but the task of the output lens is to direct light rays in the vertical direction. A combination of tasks in the horizontal and vertical direction in one output lens is difficult or nearly impracticable.

A combined lamp for motor vehicles is known from the document EP1033527 that comprises, besides a central reflector, lateral edge reflective surfaces of a concave shape, continuing the central reflector. Light rays reflected from the lateral edge reflective surfaces produce a concentrated light beam on the display surface of the carriageway that supplements the light pattern emitted by the central reflector. The light beam emitted by the lateral edge surface generally flows around the output lens. In the transversal direction to the optical axis of the headlight the lateral edge surfaces significantly exceed the edge of the output lens, increasing the total diameter of the headlight, which is undesired. Conversely, a headlight is desirable that has a smaller outer diameter enabling easier integration in the car body and adaptation of the car body design.

The document EP1970619 discloses a projection unit of a motor vehicle that comprises the basic optical elements for emitting the basic light beam on the one hand and secondary optical elements for emitting a secondary, supplementary light beam on the other hand. The secondary optical elements collaborate with secondary elements for collection of light rays or secondary elements for reflection or dispersion, designed to deflect a major part of the light emitted by the secondary light source to the direction of the basic projection optical system, and to create an additional pattern on the display surface of the carriageway. According to one of the variant embodiments, reflective surfaces surrounding the light beam emitted by the light source are assigned to the secondary LED light sources to direct the light beam to the output lens. The reflective surfaces may consist of multiple parts. The light beam may be directed on the horizontal plane, or it may be directed to a plane inclined with respect to the horizontal plane. The reflective surfaces are arranged next to the light source to capture and direct light rays that are not emitted from the light source directly, but propagate laterally in the vicinity of the planar LED light source. Since the reflective surfaces are arranged at the lateral sides of the LED light source and have a three-dimensional shape of the shell of a rounded body, they significantly exceed the edges of the light source on the transversal plane and increase the transversal cross-section of the projector. With their position and their three-dimensional shape, the reflective surfaces do not eliminate the undesired boundary between the area that is intensively lit by direct light rays and the area that is not lit by the headlight due to the light beam being trimmed by the outer lateral bevelled edges of the bushing.

The document DE19860669 discloses a projection unit of a motor vehicle with a light source, with the basic reflector for reflection of light from the light source to a convergent light beam, with an output lens and with a diaphragm arranged essentially below the optical axis to create the upper boundary of the light and darkness. In the projection unit, between the basic reflector and the output lens, another diaphragm is arranged to blind at least a part of the light that would otherwise illuminate the central area on the carriageway near the vehicle, and an additional reflector is provided to reflect and guide an additional light beam in a direction outside the output lens and to boost the lighting of the area on the carriageway near the vehicle. The reduction of the luminous intensity in the area on the carriageway near the vehicle reduces the sharpness of the transition between the lit area on the carriageway near the vehicle and the surrounding area, which is not lit by the light of the additional reflector. The additional reflector is arranged in the perimeter area of the basic reflector, bound to its front edge. The arrangement of the additional reflector increases the transversal dimensions of the basic reflector, which is not desirable. The reduction of the sharpness of the transition between the lit area on the carriageway near the vehicle and the surrounding unlit area is achieved at the expense of the total luminous intensity, which is generally undesirable.

The document WO2012109681 discloses a LED light module for lamps of motor vehicles comprising a LED light source and an output lens, and arranged between them, a light tunnel for the passage of light emitted by the LED light source. Having passed through the light tunnel and the output lens, the light of the LED light source creates an additional (contributive) light pattern on the carriageway in front of the vehicle. During the passage through the light tunnel, which has the required length, the light from the LED light source is mixed and formed in such a way that the required distribution of light is achieved. The light tunnel is created in a carrier plate made of a transparent material, and to achieve the required length of the light tunnel, a solid projection is created in its place on the carrier plate which the light tunnel passes through. The walls of the light tunnel are partly or completely fitted with a reflective surface to reflect light rays. The carrier plate is made of two parts whose dividing plane passes through the light tunnel or one of its walls. On the transparent carrier plate, more, secondary LED light sources are arranged, whose light is diffused in the transparent carrier plate, which makes the carrier plate very massive and expensive to manufacture. The carrier plate is produced with the use of injection moulding and the size of the walls of the light tunnel is limited in the light propagation direction and is insufficient for guiding of light rays. A disadvantage of this technical design is that the shape of the light tunnel cannot be flexibly adapted to the mechanical design of the headlight.

The goal of the present invention is to eliminate the above-mentioned shortcomings of the prior art, namely to eliminate the visible boundary created by the bevelled edges of the walls of the bushing or covering mask on the carriageway surface between the area that is intensively lit by direct light rays and the area where the headlight does not light due to the trimming of the light beam, and at the same time to increase the total illumination intensity of the carriageway in front of the vehicle while the shape of individual components of the contribution system can be variably adapted to the mechanical design of the entire headlight.

PRINCIPLE OF THE INVENTION

The above-mentioned goals of the invention are fulfilled by a light device, especially a headlight for motor vehicles comprising at least one light source to generate light rays, an output lens where the light rays generated by the light source enter, and lateral walls of the covering mask or bushing delimiting the space for passage of the light rays after their passage through the lens and their exit out of the light device through a transparent cover that covers the space at the front, the principle of the design being that between the light source and the output lens a reflective diaphragm is arranged that comprises reflective lateral walls for spatial delimitation between the reflective lateral walls of the beam of the light rays generated by the light source before they enter the output lens.

In one of the embodiments, the lateral walls of the reflective diaphragm are rounded at their ends adjacent to the light source.

In another one of the embodiments, the lateral walls of the reflective diaphragm comprise free ends at the side opposed from the light source. In the vertical direction, the free ends preferably have a rounded, concave shape corresponding to the inner convex shape of the output lens.

In one of the embodiments, the free ends of the lateral walls of the reflective diaphragm are offset from the surface of the output lens in the distance of 0.5 to 1.5 mm and more preferably 1 mm.

In one of the embodiments, at least one lateral wall of the reflective diaphragm has a plate-like shape.

In one of the embodiments, the inner surface of at least one of the lateral walls makes an angle equal to 0° to 30° with the optical axis on the horizontal plane.

In one of the embodiments, at least one light unit carrying a light source is deflected from the longitudinal axis of the motor vehicle on the horizontal plane in such a way that the horizontal axis passing through the light source makes an angle equal to the 0° to 20° with the longitudinal axis of the motor vehicle.

In one of the embodiments, the reflective diaphragm with its lateral walls having a plate-like shape is arranged in a frame mounted with the use of transversal holders on the carrier plate on which the light unit with the light source is mounted.

In one of the embodiments, the inner surface of one of the lateral walls of the reflective diaphragm is arranged at the inclination of 0° to 15° with respect to the vertical plane.

The present invention makes it possible to achieve a higher effect in that, on the display surface of the carriageway in front of the vehicle, a light pattern is produced that is homogeneous, does not have visible boundaries that would divide it into areas with different luminous intensities and, in spite of this, the light pattern is intensive in the required zones. The light device according to the invention makes it possible to shape the light pattern on the carriageway and to influence the luminous intensity in selected areas of the light pattern on the carriageway while it features a very efficient design, comprises parts that are easy to set or adjust, and the dimensions of individual components can be changed or adapted to the created mechanical design of the headlight.

OVERVIEW OF FIGURES IN THE DRAWINGS

Figure 2:
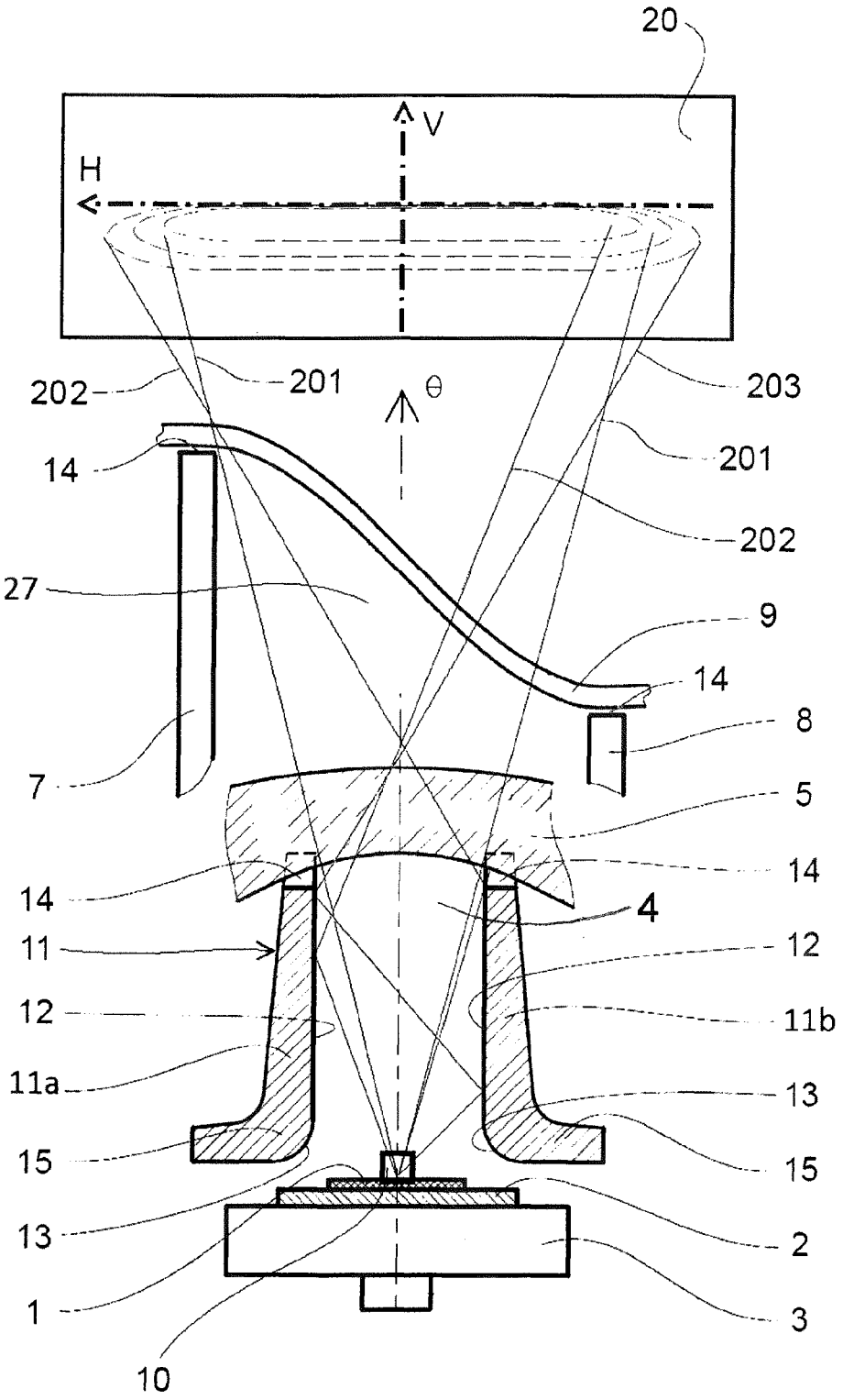
Figure 3:
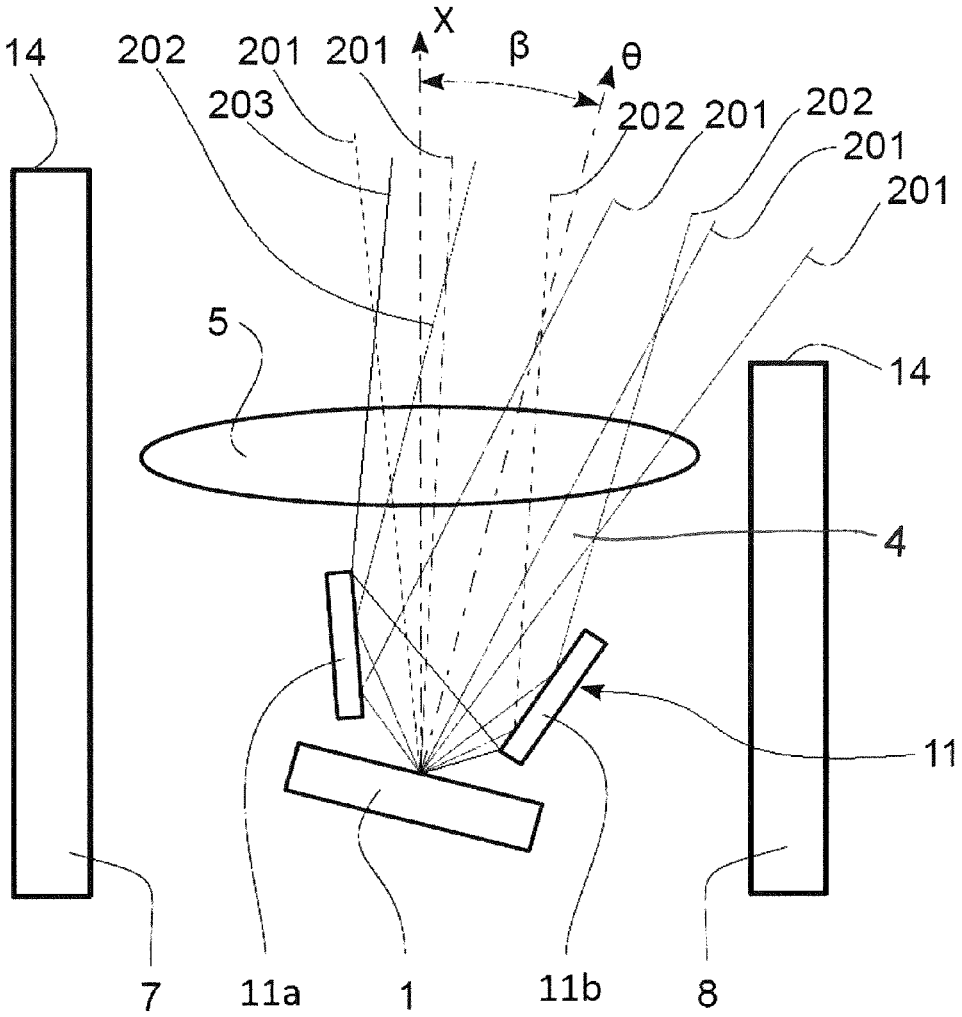
Figure 4:
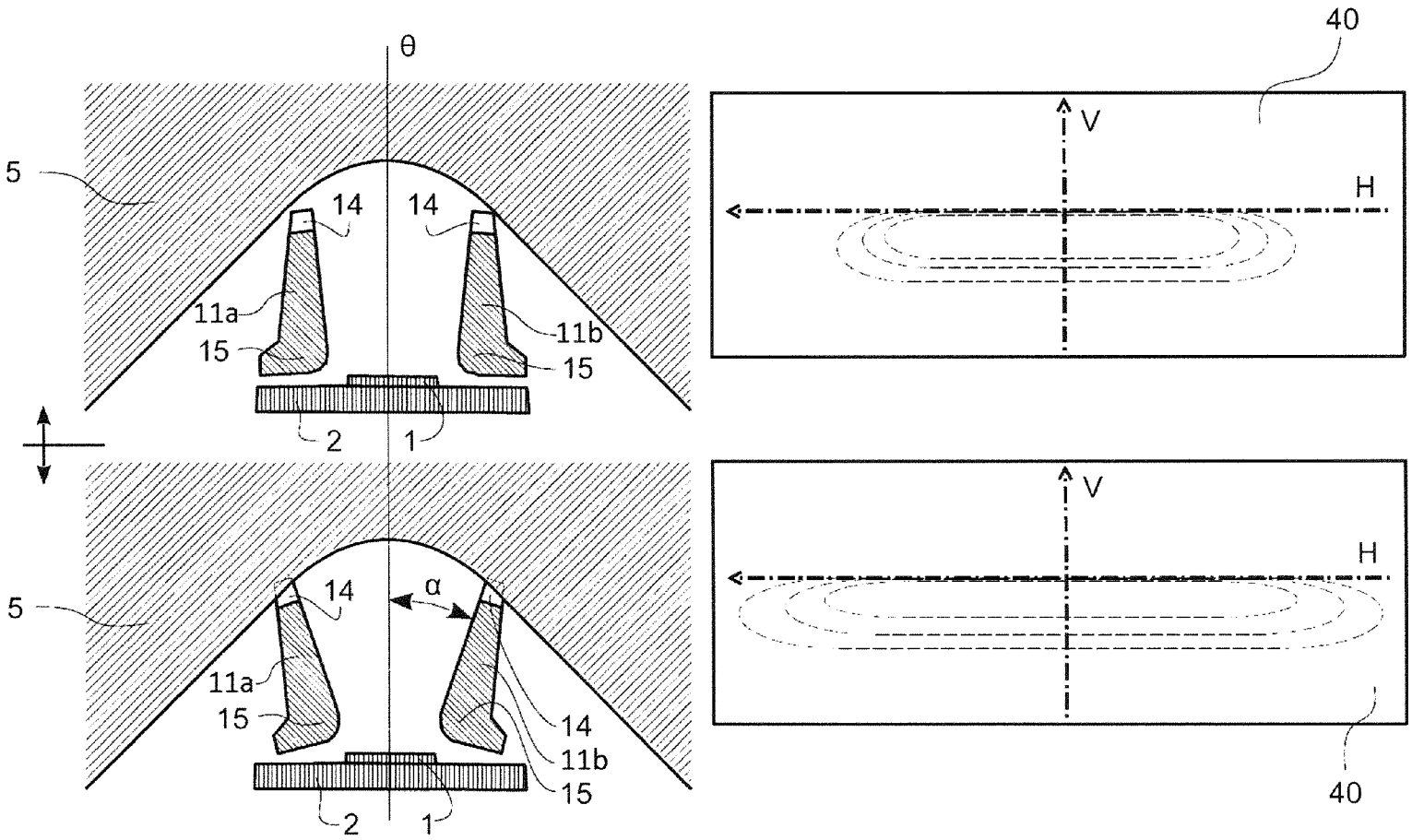
Figure 5:
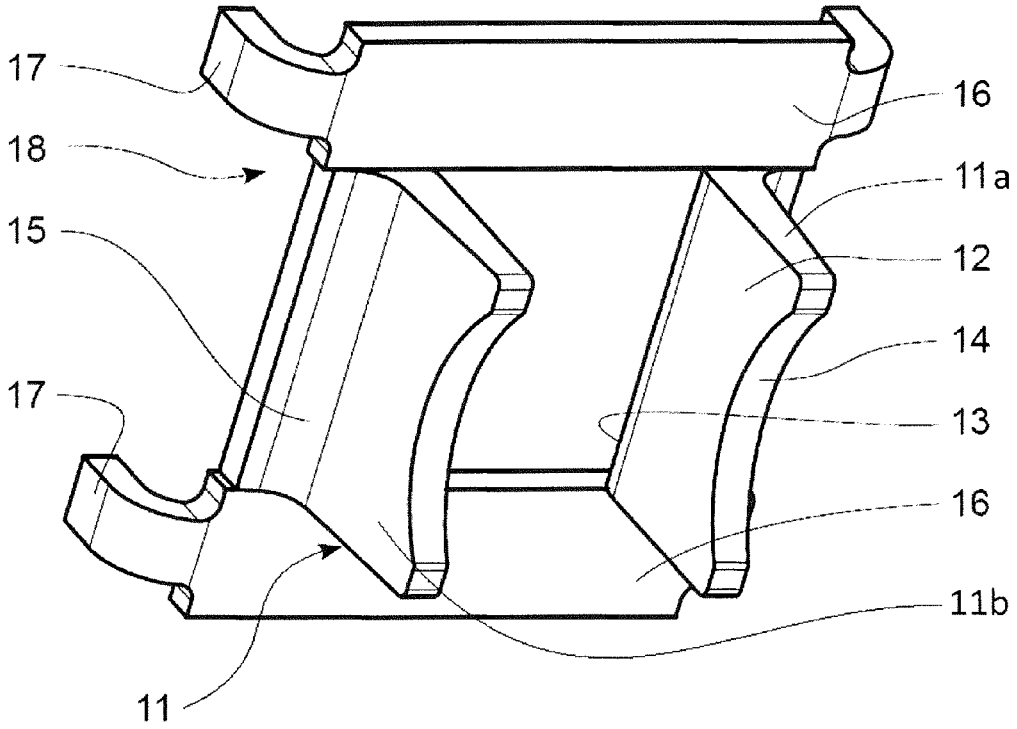
Figure 6:
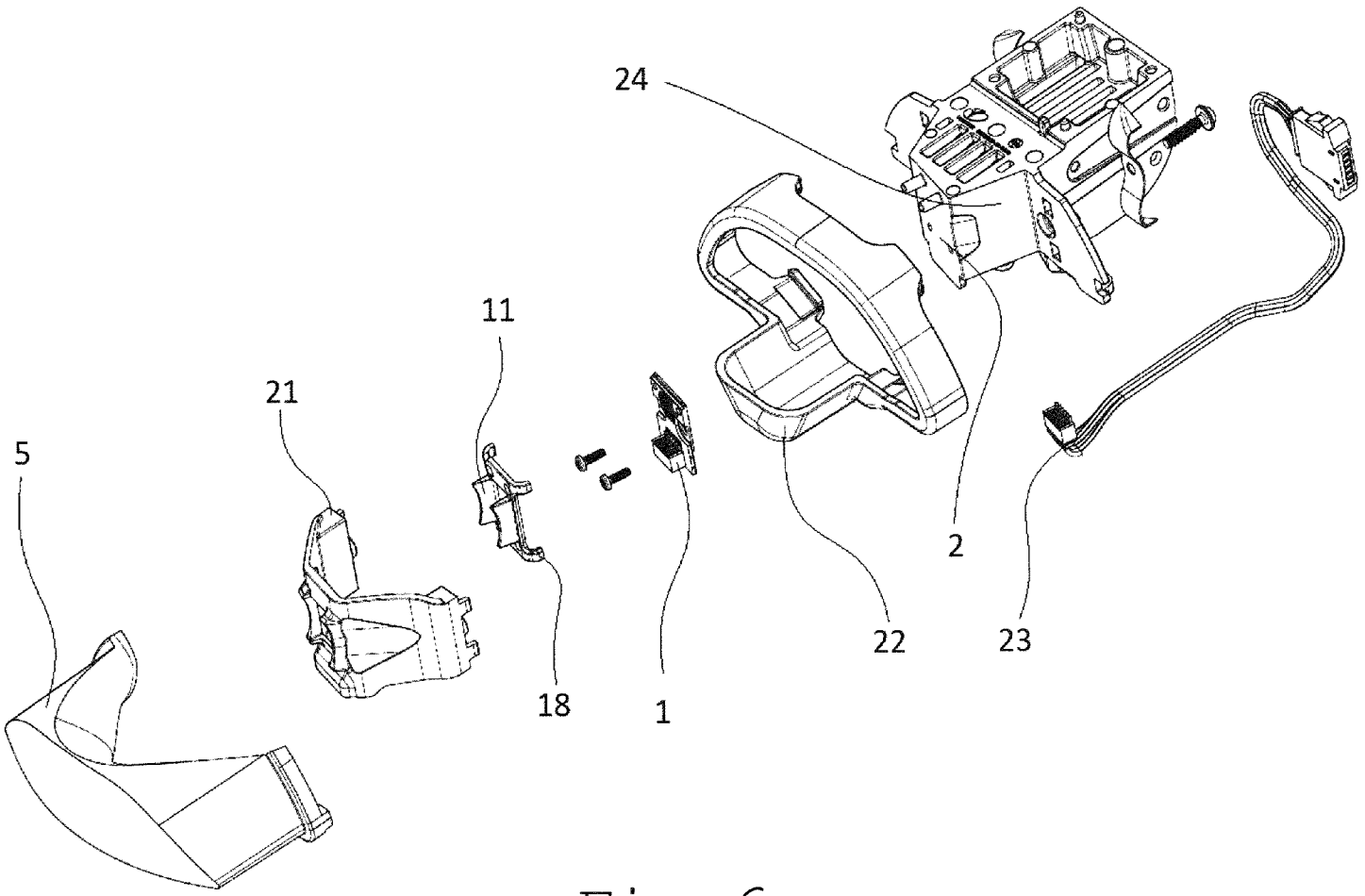
Figure 7:
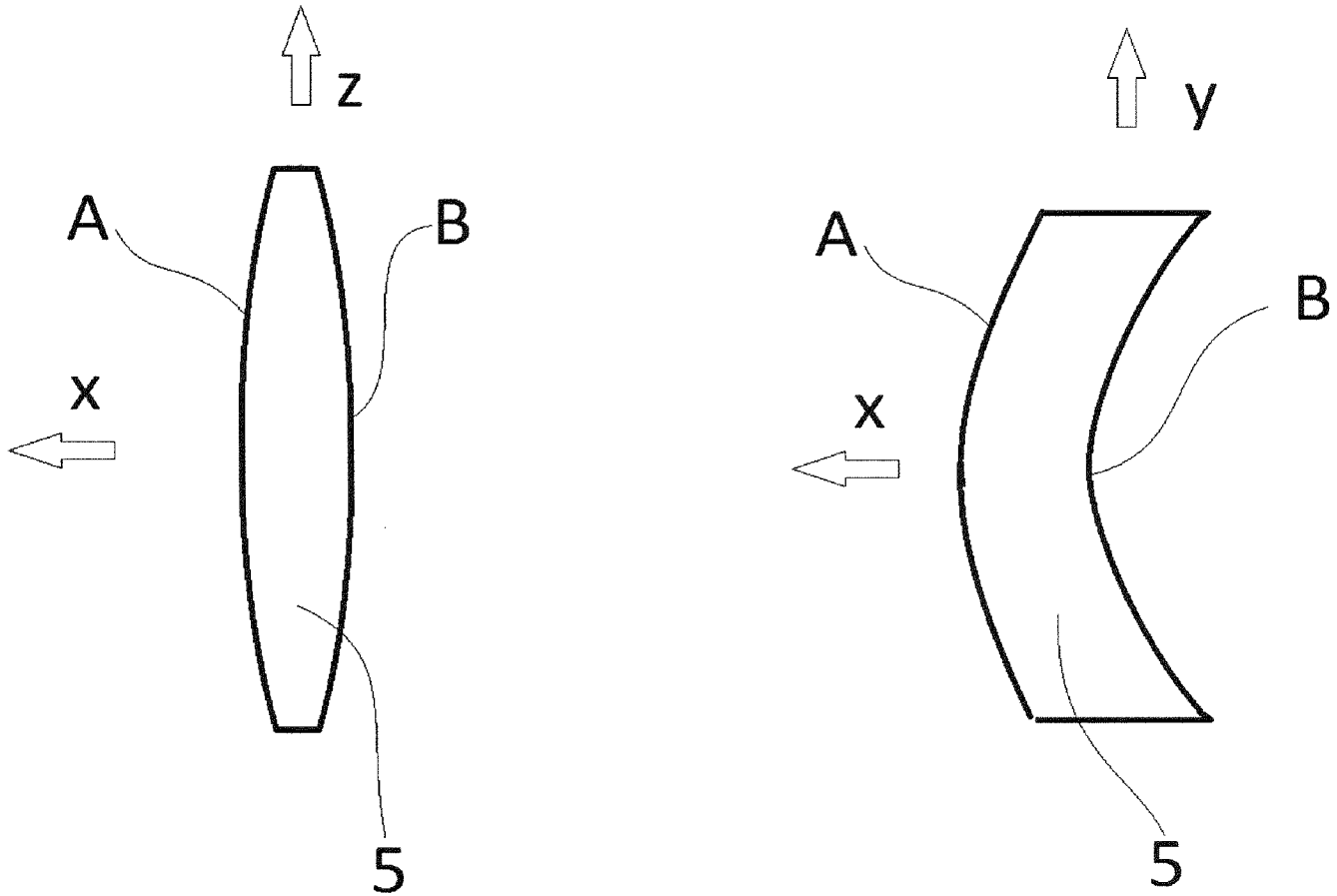

The invention will be clarified in a more detailed way with the use of its embodiment examples with references to attached drawings, where:

FIG. 1 shows a prior-art light device,

FIG. 2 shows a schematic view of an embodiment of the light device in accordance with the invention, in a partial horizontal cross-section, FIG. 3 shows a schematic view of an embodiment of the light device in accordance with the invention, with a horizontally deflected light source, FIG. 4 shows a horizontal cross-sectional view of an embodiment of the light device in accordance with the invention, with the lateral walls of the reflective diaphragm deflected at varying degrees, and the resultant patterns achieved on the display surface, FIG. 5 shows a perspective view of the structural arrangement of the reflective diaphragm within the frame, FIG. 6 shows a perspective view of an embodiment of the light device in the disassembled state, and FIG. 7 shows an embodiment of the geometry of the output lens in cross-sections along the horizontal plane and vertical plane.

EXAMPLE OF EMBODIMENTS

FIG. 1 shows a light device, especially a headlight for motor vehicles according to the prior art, comprising a carrier bushing 6 covered by a transparent cover 9 and an inner chamber 4 wherein a light unit 1 is housed, equipped with at least one light source 10 to generate light rays 101, 102, 103. The light device comprises an output lens 5 that is embedded between the inner lateral wall 7 and outer lateral wall 8 of the carrier bushing 6 of the headlight or a covering mask, which is not shown here. Due to a deep recess of the light unit 1 between the inner lateral wall 7 and outer lateral wall 8, a part of the light emitted from the light source 1 exits through a relatively narrow area between the free ends 14 of the lateral walls 7, 8 out of the light device, and a part of this light falls onto the lateral walls 7, 8 and is diffused. For design reasons, the outer lateral wall 8 has a considerably shorter length than the inner lateral wall 7, which releases the space at the outer side from the optical axis θ of the lamp in the horizontal direction. Thus, the light rays 101, 102 can exhibit a greater deflection from the light axis θ than the light rays 103, while the light rays 103 leave the inner space of the device directly, the ray 101 falling first onto the outer lateral wall 8 is directed onto the inner lateral wall 7 and it is only then that it leaves the inner space of the light device. The ray 102 is reflected from one of the lateral walls 7, 8. This gives the light beam exiting from the lamp a higher intensity at the inner side from the optical axis θ than at the outer side from the optical axis θ. The free ends 14 of the lateral walls 7, 8 produce a visible boundary on the display surface of the carriageway in front of the vehicle because the light beam is trimmed by the inner lateral wall 7. This phenomenon is manifested by the occurrence of a visible boundary between the intensively lit and the less intensively lit part of the carriageway that is not lit by the contributive projector system. This undesired visible boundary is more prominent at the inner side from the optical axis θ due to a higher luminous intensity of the light beam at the inner side from the optical axis θ while this negative phenomenon can be partly eliminated by deflecting the light unit by a certain angle with regard to the light axis θ.

FIG. 2 shows the first example of an embodiment of the light device in accordance with the invention in a horizontal cross-section. The light unit 1 comprising at least one light source 10 is mounted on a carrier plate 2 that is arranged on the cooling monobloc 3. The light rays 201, 202, 203 exit through the output lens 5 into the space 27 between the inner lateral wall 7 and the outer lateral wall 8, further passing through the transparent cover 9. The inner lateral wall 7 and the outer lateral wall 8 are lateral walls of a covering mask or bushing. Between the light unit 1 and the output lens 5, at the lateral sides of the light beam, the lateral walls 11*a* and 11*b* of a reflective diaphragm 11 are arranged opposite each other, the lateral walls preferably exhibiting a plate-like shape. Their inner surfaces 12 facing each other are reflective. The feet 15 of the lateral walls 11*a* and 11*b* that face the light source 10 have the form of a rounding 13. The free ends 14 opposed from the light source 1 have a rounded concave shape in the vertical direction corresponding to the convex shape of the output lens 5.

The inner surfaces 12 of the plate-shaped lateral walls 11*a*, 11*b* of the reflective diaphragm 11 concentrate light emitted by the light source 10 and direct light rays to the space between the free ends 14 of the lateral walls 7, 8 in such a way that the rays 201 are routed directly outside the inner space 27 of the light device, and the rays 202 are first directed to the lateral walls 11*a* and 11*b* and then they leave the inner chamber 4 of the light device without the light trace being trimmed by incidence of the rays on the lateral walls 7, 8. On the display surface 20 the light device produces an additional lit pattern below the horizontal plane H, as shown in the top part of FIG. 2. The rounding 13 of the lateral walls 11*a* and 11*b* further significantly contributes to softening of the boundary between the directly lit area on the display surface of the carriageway in front of the vehicle where the direct light rays 201 emitted by the light source 10 fall, and the area where the direct light rays do not fall. The concentration of the light rays 202, 203 by the inner surfaces 12 ensures a high utilization rate of the light emitted by the light unit 1.

The utilization rate of the light emitted by the light source 10 is further considerably increased by the fact that the free ends 14 of the lateral walls 11*a* and 11*b* opposed from the light unit 1 have a rounded concave shape in the vertical direction, corresponding to the inner convex shape of the output lens 5, while the outer edges 14 are preferably offset from the output lens 5 in the distance of 0.5 mm to 1.5 mm and more preferably in the distance of 1 mm. 1 mm is considered as an optimum distance to meet the mechanical and operational requirements of the production and operation of the light device wherein the output lens 5 and reflective diaphragm 11 are separately manufacturable parts.

FIG. 3 shows the second example of an embodiment of the light device according to the present invention, wherein the deflection of the reflective diaphragm 11 with respect to the optical axis θ increases the utilization rate of light because it enables guiding of most of the rays 201, 202, 203 emitted by the light unit 1 between the free ends 14 of the lateral walls 7, 8, while the shape and length of the lateral walls 11*a*, 11*b* of the reflective diaphragm 11 can be different on the inner and outer side so that the rays 201 can be directly radiated between the free ends 14 of the lateral walls 7, 8, the rays 202 can be directed between the free ends 14 of the lateral walls 7, 8 by reflection from at least one of the lateral walls 11*a*, 11*b*, and the rays 203 can be guided outside the inner chamber 4 of the light device through a multiple reflection from two lateral walls 11*a*, and 11*b*. The shape and length of the reflective diaphragm 11 are influenced by the mechanical design of all the components of the headlight, wherein the length and/or shape are adapted to direct the rays 201, 202, 203 in such a way that these rays 201, 202, 203 should not get in contact with the lateral walls 7, 8 of the covering mask or carrier bushing.

The light unit 1 is preferably deflected from the longitudinal axis X of the motor vehicle in such a way that the optical axis θ passing through the light unit 1 makes the light source deflection angle β=0°-20°, preferably 10° with the longitudinal axis X of the motor vehicle. The deflection of the light source 10 or the carrier plate 2 of the light unit 1 achieves the effect that the final light beam of the lamp is directed between the trim edges of the lateral walls 7, 8 even better.

The setting of the position of the reflective lateral walls 11*a*, 11*b* of the reflective diaphragm 11 with respect to the optical axis θ is illustrated in more detail in FIG. 4, showing another embodiment of the light device according to the invention, with deflected reflective lateral walls 11*a*, 11*b* of the reflective diaphragm 11. At least one reflective lateral wall 11*a*, 11*b* having a plate-like shape makes the lateral wall deflection angle α=0°-30° with the optical axis θ. The possibility to set the angle α of the lateral walls 11*a*, 11*b* with respect to the optical axis θ makes it possible to select the area where the rays 201, 202, 203 should be directed. Changing the angle and distance between the lateral walls 11*a*, 11*b* allows you to adjust the softness of the boundaries and the level of light concentration on the display surface 40 of the carriageway in front of the vehicle, with the light pattern displayed in FIG. 4 being shown with respect to the horizontal plane H and the vertical plane V. The differences in the light pattern on the display surface 40 are apparent from the right sides of FIG. 4, wherein the top part shows the reflective lateral walls 11*a* and 11*b* arranged with their reflective inner surfaces 12 almost parallel to the optical axis θ, and the bottom part shows the reflective lateral walls 11*a* and 11*b* deflected from the optical axis θ by the angle α. The position of the lateral walls 11*a* and 11*b* is preferably also adjustable in the vertical direction, preferably in the inclination of 0°-15° with respect to the vertical plane V.

FIG. 5 shows the reflective diaphragm 11 of a plate-like shape forming a frame 18 together with the transversal holders 16. The roundings 13 influence, as mentioned above, the softness of the light boundary on the display surface between the directly lit area and the unlit area. The transversal holders 16 are fitted with support feet 17 for mounting on the not shown carrier plate 2 of the light source 10. The frame 18 can be preferably mounted onto the carrier plate 2 with the use of clips or latches. FIG. 5 clearly indicates that the position of the reflective lateral walls 11*a* and 11*b* wherein their respective free ends 14 are easily adjustable between the transversal holders 16 thanks to the shaped feet 15. The adjustment is possible by rotating around the axes passing through the feet 15, in parallel to the roundings 13.

FIG. 6 shows a disassembled view of an embodiment of the light device comprising a shaped output lens 5 with an adjacent holder carrier 21 of the reflective diaphragm 11 integrated in the frame 18. In the frame 18, the light unit 1 is mounted, all of which are within the lens holder 22, which itself is mounted to the output lens 5. The light unit 1 is further mounted on the carrier plate 2, which is part of the cooler 24, and which is connected to the power supply with the cabling 23.

FIG. 7 shows the shape of the lens 5, where the front surface A results from the style requirements and in the optical design the given surface cannot be changed. The rear surface B is spatially shaped in such a way that in the vertical cross-section the lens is biconvex and in the horizontal cross-section it is a convex-concave lens. The horizontal axis H which is perpendicular to the longitudinal axis of the vehicle, and the vertical axis Z which is perpendicular to axis X and axis Y, are both of these are shown in FIG. 7 for reference purposes.

LIST OF REFERENCE MARKS

1 light unit
2 carrier plate
3 cooling monobloc
4 inner chamber
5 output lens
6 bushing
7 lateral wall
8 lateral wall
9 transparent cover
10 light source
11 reflective diaphragm
11*a* lateral wall
11*b* lateral wall
12 inner surface
13 rounding
14 free end
15 foot
16 transversal holder
17 support foot
18 carrier frame
20 display surface
21 diaphragm carrier
22 lens holder
23 cabling
24 cooler
27 space
40 display surface
101 ray
102 ray
103 ray
201 ray
202 ray
203 ray
H horizontal plane (comprising axes X, Y)
V vertical plane (comprising axes Z, Y)
θ optical axis of the lamp
α deflection angle of the lateral walls
β deflection angle of the carrier plate
A front surface of lens
B rear surface of lens
X longitudinal axis of the vehicle
Y horizontal axis perpendicular to the longitudinal axis of the vehicle
Z vertical axis perpendicular to axis X and Y

The invention claimed is:

1. A light device comprising:

at least one light source configured to generate light rays;

an output lens where the light rays generated by the light source enter; and lateral walls delimiting a space for passage of the light rays after their passage through the lens and for their exit out of the light device through a transparent cover that covers the space at the front, wherein between the light source and the output lens a reflective diaphragm is arranged that comprises: fixed, immovably arranged reflective lateral walls for spatial delimitation between the reflective lateral walls of the beam of the light rays generated by the light source before they enter the output lens, wherein the output lens has, in the vertical direction at the side facing the reflective diaphragm, a convex shape and the reflective lateral walls include, at the side facing the output lens, free ends that have a rounded concave shape in the vertical direction, wherein the concave shape of the free ends is substantially complementary to the convex shape of the output lens.

2. The light device according to claim 1, wherein the reflective lateral walls of the reflective diaphragm are provided with a rounding at their ends facing the light source.

3. The light device according to claim 1, wherein the free ends are offset from the surface of the output lens in the distance of 0.5 to 1.5 mm, and preferably in the distance of 1 mm.

4. The light device according to claim 1, wherein at least one of the reflective lateral walls has a plate-like shape.

5. The light device according to claim 1, wherein the inner surface of at least one of the reflective lateral walls makes an angle equal to 0° to 30° with the optical axis on the horizontal plane.

6. The light device according to claim 1, wherein at least one unit carrying the light source has such an angular position from the longitudinal axis of the motor vehicle on the horizontal plane, such that the optical axis passing through the light source makes an angle equal to 0° to 20° with the longitudinal axis of the motor vehicle.

7. The light device according to claim 1, wherein the reflective diaphragm with the reflective lateral walls of a plate-like shape is arranged in a frame, mounted by means of transversal holders on the carrier plate that the light unit with the light source is mounted on.

8. The light device according to claim 1, wherein the inner surface of at least one of the reflective lateral walls of the reflective diaphragm is arranged at an inclination of 0° to 15° with respect to the vertical plane.

* * * * *